US006811050B2

(12) United States Patent
Bergeron

(10) Patent No.: US 6,811,050 B2
(45) Date of Patent: Nov. 2, 2004

(54) PACKING TRAY

(75) Inventor: Mark A. Bergeron, Lithonia, GA (US)

(73) Assignee: Tekni-Plex, Inc., Somerville, NJ (US)

( * ) Notice: Subject to any disclaimer, the term of this patent is extended or adjusted under 35 U.S.C. 154(b) by 0 days.

(21) Appl. No.: 09/790,784

(22) Filed: Feb. 22, 2001

(65) Prior Publication Data

US 2001/0032855 A1 Oct. 25, 2001

Related U.S. Application Data

(60) Provisional application No. 60/183,854, filed on Feb. 22, 2000.

(51) Int. Cl.[7] ..... B65D 1/00

(52) U.S. Cl. ..... 220/508; 220/516; 220/517; 206/521.1

(58) Field of Search ..... 220/508, 516, 220/517, 507, 513, 639; 206/521.1, 521.8, 521.9

(56) References Cited

U.S. PATENT DOCUMENTS

| | | | | | |
|---|---|---|---|---|---|
| 1,477,921 | A | | 12/1923 | Thompson | |
| 2,774,473 | A | | 12/1956 | Willams | 206/65 |
| 3,040,923 | A | | 6/1962 | Leitzel | 217/26.5 |
| 3,262,786 | A | | 7/1966 | Weiss | 99/171 |
| 3,603,499 | A | * | 9/1971 | Snow | 206/521.8 |
| 3,887,123 | A | | 6/1975 | Hattingh | 229/2.5 |
| 3,962,469 | A | | 6/1976 | Leavens et al. | 426/108 |
| 3,987,922 | A | | 10/1976 | Kaira | 217/26.5 |
| 4,195,743 | A | | 4/1980 | Emery | 217/265 |
| 4,333,571 | A | | 6/1982 | Martelli | 206/499 |
| 4,795,080 | A | * | 1/1989 | McIntyre | 206/521.1 |
| 4,872,608 | A | * | 10/1989 | Lake | 206/521.1 |

* cited by examiner

*Primary Examiner*—Joseph Man-Fu Moy
(74) *Attorney, Agent, or Firm*—Pitney Hardin LLP

(57) ABSTRACT

A packing tray is provided for use in both cell pack and tray pack arrangements. The packing tray is unitarily formed from polystyrene foam to have a cellular structure. Cells are arranged in longitudinal rows of alternating odd and even numbers, and the cells are partially separated by cell dividers, which have at least major portions recessed within the tray.

15 Claims, 5 Drawing Sheets

PACKING TRAY

CROSS-REFERENCE TO RELATED APPLICATIONS

This Application claims priority of U.S. Provisional Patent Application No. 60/183,854, filed Feb. 22, 2000.

BACKGROUND OF INVENTION

This invention relates to packing trays and, more particularly, to polystyrene foam trays for packing fruit, and other fragile objects.

In the prior art, two basic types of tray packaging have been developed that are commonly used to package fruit, and other fragile objects, such as light bulbs: tray packs and cell packs. (To illustrate the invention, reference herein is made to fruit; other fragile objects can be packed in similar fashion). First, "tray packs" are single stacked trays in which fruit is accommodated. The cells of the tray packs are relatively shallow to maximize the number of cells per unit area formed on a tray.

A tray pack that is commonly found in the prior art is embodied in U.S. Pat. No. 3,040,923 to Leitzel, which was issued on Jun. 26, 1962 and is entitled "MOLDED PULP PACKING TRAY". The Leitzel tray is representative of a typical prior art design and is formed with a plurality of cells, wherein sinuous ridges are formed to separate the cells in a transverse direction, while flat planar portions are used to separate the cells in longitudinal directions. The crests of the sinuous ridges are formed to be higher than the planar portions and to be generally coplanar with the edge of the tray. When stacked, the planar portions of an upper tray bear against fruit packaged in a lower tray. To minimize bruising of the fruit, U.S. Pat. No. 3,040,923 states that contact between packaged fruit and the external surfaces of the cells of an upper tray are not desired. Therefore, it is intended that the planar portions solely bear against the fruit of a lower tray.

U.S. Pat. No. 3,962,469 to Leavens et al. which was issued on Jun. 8, 1976 and is entitled "FRUIT TRAY PACKAGE" discloses a fruit tray package arrangement which uses the tray pack disclosed in U.S. Pat. No. 3,040,923. Here, however, it is noted that the Leitzel tray has a shortcoming, wherein a smaller piece of fruit, which is not sufficiently large enough to come into bearing engagement with the associated planar portion of an upper stacked tray, is free to shift about the cell and may be damaged during shipping. To overcome this deficiency, Leavens et al. discloses using a plastic film envelope about each tray which is intended to provide a downward bearing force against each piece of packaged fruit, taking into account variations in size.

Second, "cell packs" have been used in the prior art wherein a pair of cooperating trays is disposed in facing relationship to define the cell pack, with fruit being wholly encapsulated between vertically aligned cells of the upper tray and the lower tray. An example of a cell pack is disclosed in U.S. Pat. No. 1,477,921 to Thompson which was issued on Dec. 18, 1923 and is entitled "FRUIT CARRIER".

For transportation and/or storage, packaged cell packs are stacked in cases, or other transportation and/or storage units, often with the cells of all of the cell packs being vertically aligned. Thus, the packaged and stacked cell packs typically do not have any portions in nesting interengagement (i.e., the height of n number of stacked and packaged cell packs is equal to the sum of the individual heights of the packaged cell packs). Alternatively, the Thompson cell pack is made in two variations to allow for nesting, wherein the two variations of cell pack are alternated in a stacked arrangement.

Tray packs are packaged and stacked in cases with cells of an upper-stacked tray being nested between the packaged fruit of a lower-stacked tray (i.e., the height of n number of stacked and packaged tray packs is less than the sum of the individual heights of the packaged tray packs). In similar vein to the Thompson cell pack, some tray pack designs are formed in two variations to allow for efficient stacking within the same container. The two designs have different cell arrangements to allow for efficient nesting, yet the tray packs may be stacked within a rectangular cross-sectional container with the edges of the stacked trays being in registration.

It is an object of the subject invention to provide a packing tray suitable for use both in a tray pack arrangement and in a cell pack arrangement.

It is also an object of the subject invention to provide a packing tray which provides sufficient protection from external hazards, yet is sufficiently versatile to accommodate fragile objects, including fruit, of different sizes, and in different packing orientations.

SUMMARY OF THE INVENTION

The aforementioned objects of the subject invention are met by a packing tray preferably formed from a sheet of polystyrene foam which is molded into a cellular structure. The cellular structure includes longitudinal rows of cells, wherein alternating rows include odd and even numbers of cells. Preferably, the even number rows include one more cell than the odd number rows. For example, a first row may have six cells, an adjacent row five cells, the following row six cells, and so forth. The cells are arranged so that the centers of even number rows and odd number rows are respectively centered relative to one another. In addition, the centers of the cells of the odd number rows are interposed between the cells of even number rows, and preferably aligned to be centrally disposed between the even number cells.

The packing tray is further formed with a peripheral edge which defines a reference plane. Within the packing tray, and bounded by the peripheral edge, is a network of cell dividers which at least partially separate the respective cells. The cell dividers are generally saddle-shaped in cross-section and formed to blend between adjacent cells. Also, posts are located at junctures of cell dividers. It is preferred that the top surfaces of the posts be generally coplanar with the reference plane defined by the peripheral edge, whereas, at least major portions of the cell dividers be recessed below the reference plane. In this manner, the packing tray has a peripheral edge which provides protection for packaged fruit from external forces, yet the tray has relatively low cell dividers which provide versatility in the size of the objects to be packaged, as well as the packaging orientation of the objects, whether being horizontal, vertical, or oblique.

With the cellular structure described above, the packing tray of the subject invention can be used in a tray pack application where trays can be reversed end-to-end and stacked upon one another. In contrast to the manner of packing the prior art Leitzel tray, fruit, or other objects, packed with the tray of the subject invention will preferably simultaneously bear against the exterior surfaces of at least two cells of an upper-stacked tray. The simultaneous engagement against the upper cells limits the relative movement of the fruit, or object, and prevents bruising thereof. Due to the forgiveness of the constituent foam material of the packing tray, and the smooth outer surfaces of the cells, it has been found that the bearing engagement of the cells against the fruit is acceptable and does not result in excessive bruising, or other damage. The Leitzel tray is formed from molded pulp which does not define smooth outer surfaces, and the inherent forgiveness of the material is much more limited than that of polystyrene foam.

Additionally, the packing tray of the subject invention can be used in a cell pack arrangement, wherein two of the packing trays can be placed in facing relationship to encapsulate fruit or other objects. The cell dividers and the posts provide for separation between adjacent packed objects. In addition, the increased heights of the peripheral edges of the two packing trays from the respective cell divider networks cause the peripheral edges to depend over substantial portions of the peripheries of the cell pack to provide a buffer against external forces while in a cell pack arrangement—it should be noted that it is preferred that the peripheral edges do not contact. If the depths of the cells were to be increased so as to enable abutting contact between the peripheral edges of the two trays in a cell pack arrangement (as in the prior art), the number of cells the packing trays could accommodate would be limited. To achieve the highest economy of a tray, the greatest number of cells per unit area is to be provided. The subject invention achieves this objective by having the peripheral edges be spaced apart in a cell pack arrangement (in contrast to the prior art), without sacrificing the amount of protection afforded packaged objects.

These and other features of the invention will be better understood through a study of the following detailed description and accompanying drawings.

DETAILED DESCRIPTION OF THE INVENTION

Figure 1:
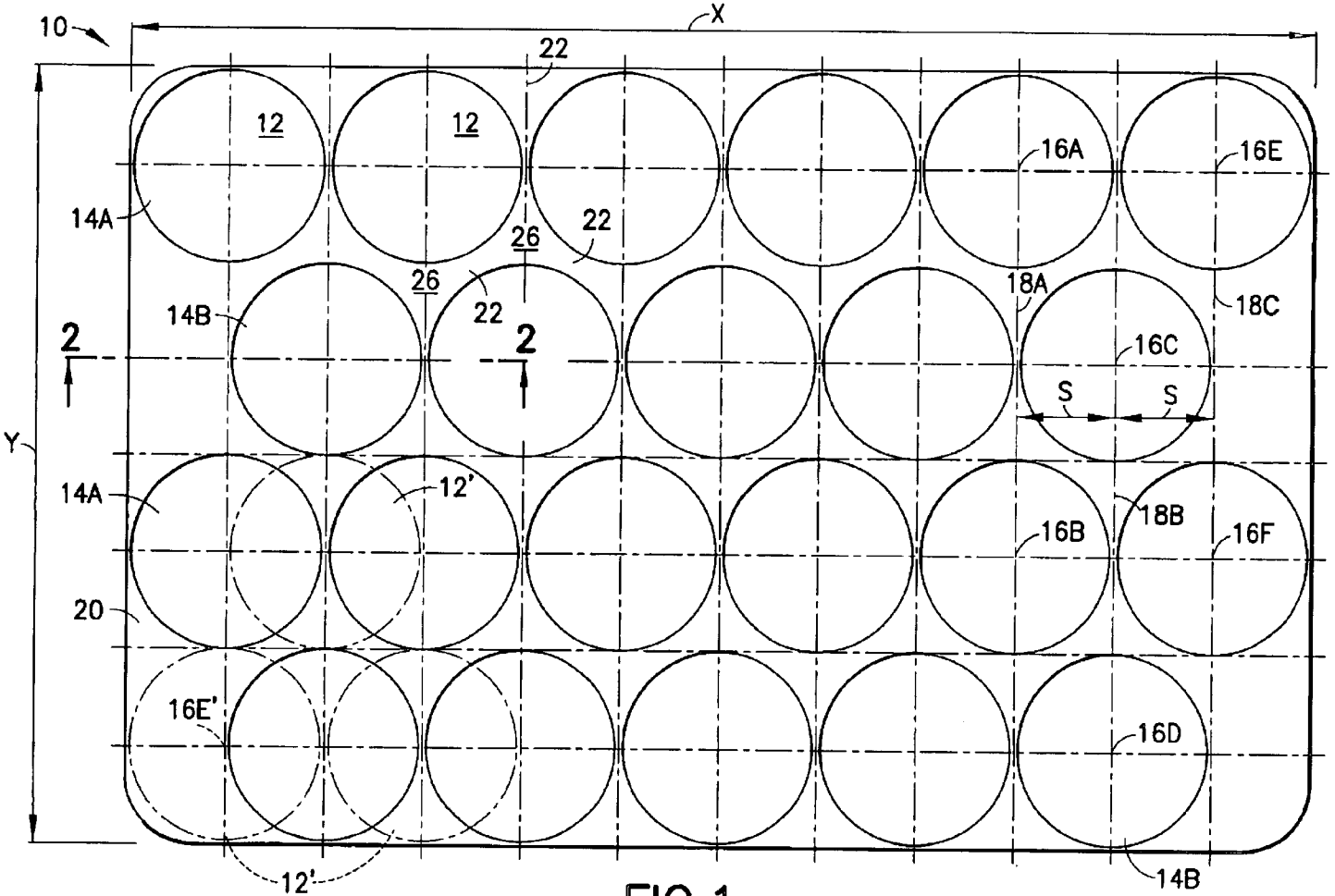
FIG. 1 is a top plan view of a packing tray formed in accordance with the subject invention.

Referring to the Figures, a packing tray is shown and generally designated with the reference numeral 10. The packing tray 10 is preferably formed from a single sheet of polystyrene foam using techniques known by those skilled in the art and is preferably formed with matching upper and lower surfaces so that the packing tray 10 can be stacked in nesting engagement with similarly-shaped packing trays 10. The packing tray 10 is particularly well-suited to pack fruit and other comestibles, but can be used as well to pack other fragile objects, such as light bulbs. By way of non-limiting example, reference is made herein to packaging fruit to describe the invention.

The packing tray 10 has a cellular construction with a plurality of cup-shaped cells 12 formed to accommodate the fruit to be packed therein. The cells 12 are arranged in longitudinal rows, where is it is preferred that alternating rows include odd and even numbers of cells. More preferably, the even number rows include one more cell than the odd number rows. For example, rows 14A include six of the cells 12, while rows 14B include five of the cells 12. It is preferred that the centers of the cells of alternating rows 14A, 14B be aligned laterally. To illustrate this point, reference is made to cell centers 16A–16F, wherein lateral axes 18A–18C are respectively defined between pairs of cells centers 16A–16B, 16C–16D, 16E–16F, respectively. It is preferred that the lateral axes 18A–18C be generally parallel. It is also preferred that the cell centers 16C, 16D of the odd number rows 14B be centered relative to the cell centers 16A, 16B, 16E, 16F of the even number rows 14A. With this arrangement, the lateral axis 18B is generally equidistant from both of the lateral axes 18A and 18C, being spaced a distance S from each. It is also preferred that an even number of total rows 14A, 14B be provided to allow for reversed end-to-end stacking as described below. As shown in FIG. 1, four total rows 14A, 14B are defined in the tray 10.

The packing tray 10 is generally rectangular shaped, with a longitudinal dimension X and a lateral dimension Y. The dimensions X, Y can be varied to accommodate various numbers of the cells 12. To maximize the economy of the packing tray 10, it is preferred that the greatest numbers of the cells 12 be provided within the area X-Y that is feasible.

Figure 2:
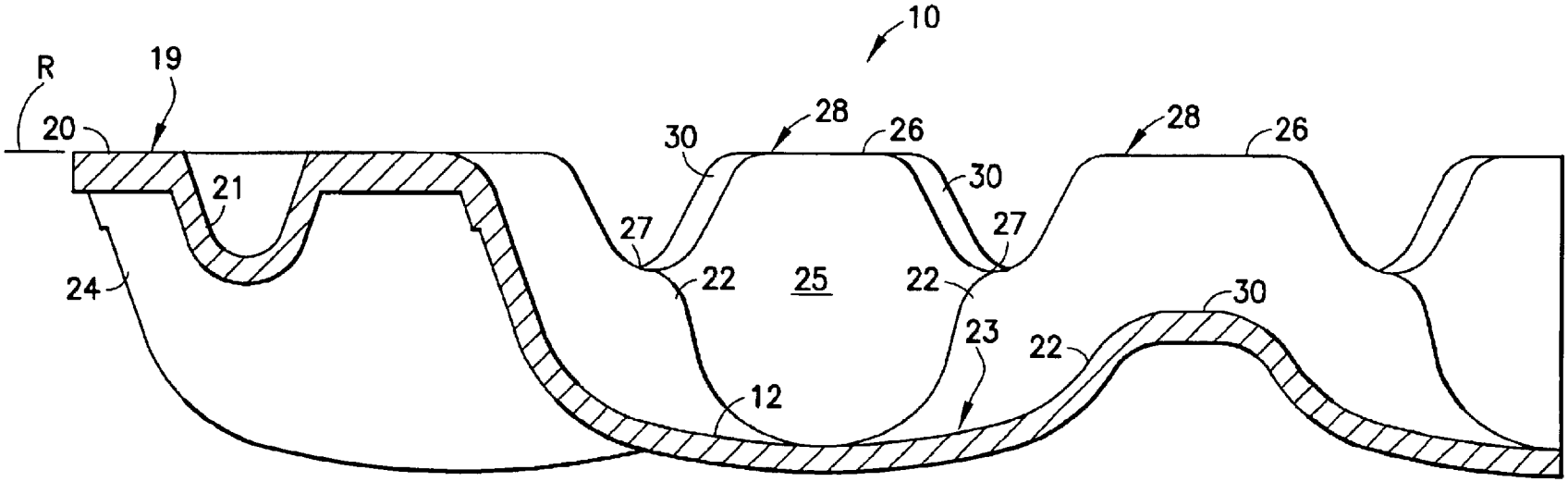
FIG. 2 is a partial cross-sectional view taken along line 2—2 of FIG. 1.

A peripheral edge 20 extends about the perimeter of the packing tray 10 with an upper surface 19 having co-planar portions that define a reference plane R, as shown in FIG. 2. The peripheral edge 20 may also be interrupted by reliefs 21, which provide rigidity to the packing tray 10. The peripheral edge 20 is formed as a flange of the packing tray 10 and has varying widths. For example, the peripheral edge 20 defines a greater width between the perimeter of the packing tray 10 and the cell 12 designated with the cell center 16C than the width defined between the perimeter of the packing tray 10 and the cell 12 designated with the cell center 16E.

Bounded by the peripheral edge 20 is a network of cell dividers 22 which are generally saddle-shaped in cross-section and formed to separate, and blend with, adjacent cells 12. Further, posts 26 are located at junctures of the cell dividers 22. As shown in the FIGS., the posts 26 may be located at junctures of three of the cell dividers 22, but other arrangements are possible. It is preferred that top surfaces 28 of the posts 26 be generally coplanar with the reference plane R, while at least major portions of the cell dividers 22 be recessed below the reference plane R. (As used herein, a "major portion" of a cell divider is at least half the length of the cell divider.) With reference to FIG. 2, major portions of the crests 30 of the cell dividers 22 are recessed below the reference plane R. The crests 30 preferably blend with the top surfaces 28 of the posts 26 and with the upper surface 19 of the peripheral edge 20, and, thus, the blended portions of the crests 30 are not recessed below the reference plane R. If the crests 30 were to blend with the posts 26 below the top surfaces 28 and with side walls (defined below) of the cells 12, the cell dividers 22 would be wholly recessed below the reference plane R.

The cells 12 are generally cup-shaped and each is defined, to varying extents, by a combination of the cell dividers 22, the posts 26 and side walls 24. For illustrative purposes, with reference to FIG. 1, the cell 12 located at the corner of the packing tray 10 and designated with the cell center 16E is defined by two of the cell dividers 22, one of the posts 26 and one of the side walls 24 (see FIG. 2); the cell 12 located at the periphery of the packing tray 10, but not at any of the corners, and designated with the cell center 16C, is defined by five of the cell dividers 22, four of the posts 26, and one of the side walls 24; and, the cell 12 located on the interior of the packing tray 10 and designated with the cell center 16B is defined by six of the cell dividers 22 and six of the posts 26. The specific construction of the cells 12 depends on the location of the cell 12 relative to other of the cells 12 and relative placement on the packing tray 10.

Also, the cells 12 are each formed with a bottom 23. Depending on the particular cell 12, the cell dividers 22, the posts 26 and the side walls 24 extend continuously upwardly from the cell bottom 23 so as to bound the cell bottom 23. The shape of the cell bottoms 23, as well as the cell dividers 22, the posts 26 and the side walls 24 is dictated by the fragile objects that are to be packed in the packing tray 10. For example, fruit is generally spherical (or at least has spherical portions) and thus the cells 12 are shaped accordingly—the cells bottoms 23 are dished, and the cell dividers 22, the posts 26 and the side walls 24 are arcuately shaped in two coordinate directions. The cells 12 need not be formed about a single radius and varying curvatures are possible. In addition, the lengths of the cell dividers 22, the posts 26 and the side walls 24 may be varied.

Figure 3:
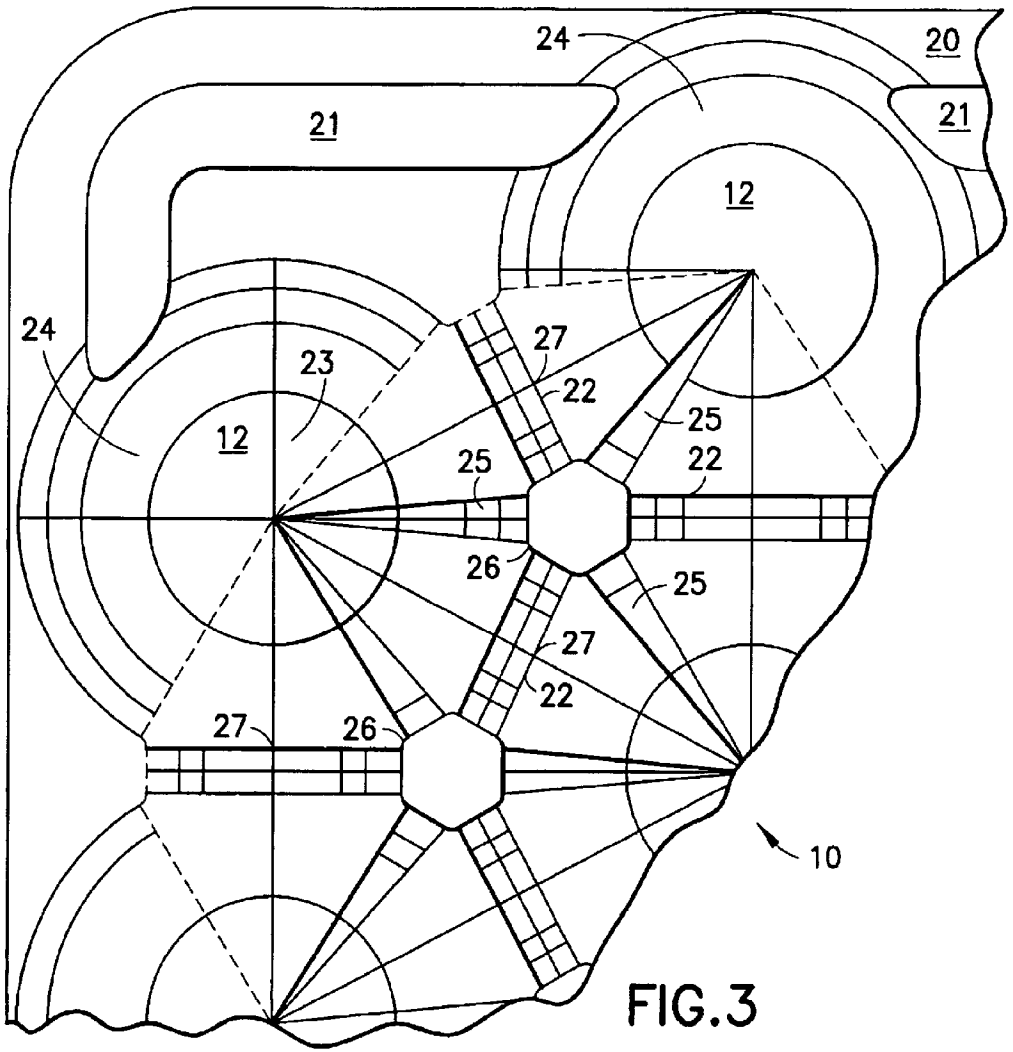
FIG. 3 is a partial bottom plan view of the packing tray.

With reference to FIG. 3, the posts 26 are each generally formed with a tapered six-sided shape that terminates with the top surface 28 being generally hexagonal. For each of the posts 26, three of the cell dividers 22 define three of the sides. In between the cell dividers 22, the posts 26 have post walls 25 that extend continuously between adjoining cell dividers 22 so as define uninterrupted surfaces in the cells 12. At the periphery of the packing tray 10, the cell dividers 22 extend between one of the posts 26 and the peripheral edge 20. The side walls 24 sweep about the respective cell 12 and connect the cell dividers 22 where there is no post 26.

It should be noted that in forming the packing tray 10, the cells 12, and features thereof, are sculpted into the constituent foam material. Although there are transitional surfaces and directional changes in the surfaces, the various transition surfaces and changes in direction are blended together in an aesthetically-pleasing manner so that the changes are relatively imperceptible. Sharp corners are generally avoided. FIG. 3 is a partial bottom plan view of the packing tray 10 showing the corner of the packing tray 10 which is in proximity to cell 12 designated with the cell center 16D in FIG. 1. In FIG. 3, dashed lines partially bound an area of the packing tray 10 in which solid lines demarcate for illustrative purposes the transition surfaces and changes of direction. The remainder of the packing tray 10 is formed in similar fashion.

Referring again to FIG. 2, the cell dividers 22 are preferably convexly shaped in profile so as to each define a low point 27. Preferably, the low point 27 is located at a mid-point between adjoining posts 26, or at a mid-point between the peripheral edge 20 and adjoining post 26 where the cell divider 22 extends from the peripheral edge 20, and, more preferably, at the respective central mid-point. As a result of this structural arrangement, the side walls 24 extend coextensively with the posts 26 and beyond at least major portions of the cell dividers 22.

Figure 4:
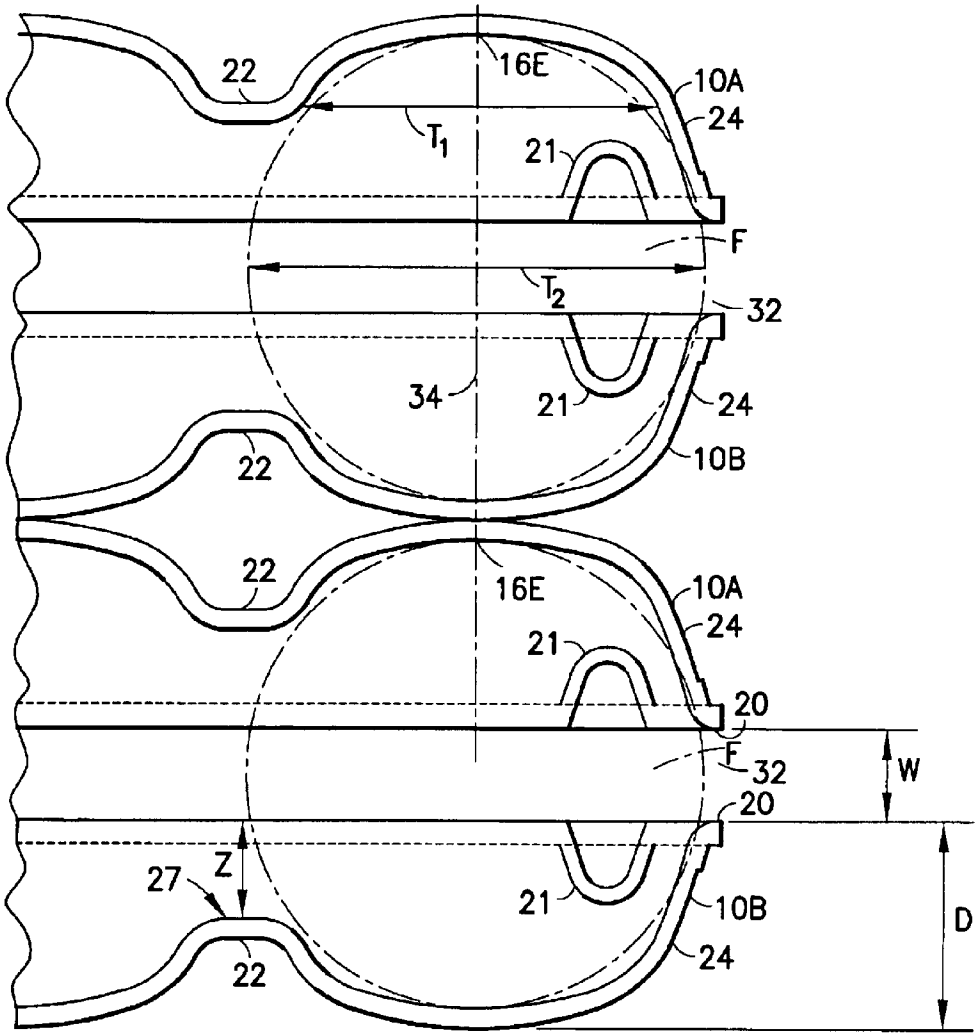
FIG. 4 is a schematic showing the packing tray of the subject invention being used in a cell pack arrangement.

The packing tray 10 of the subject invention can advantageously be used in both cell pack and tray pack applications. With reference to FIG. 4, two of the packing trays 10A, 10B can be placed in facing relation, such that fruit F can be packaged therebetween. The odd/even numbering of the cells 12 described above, allows for the packing trays 10A, 10B to be of identical construction, but in inverted relation with the rows 14A and the rows 14B of the two trays 10A and 10B being vertically aligned.

In contrast to the prior art, the packing trays 10A, 10B do not fully encapsulate the fruit F. Rather, a gap 32 is defined therebetween having a width W. By having the gap 32, depth D of the cells 12 (as measured from the peripheral edge 20) is limited. It is preferred that the depth D be less than one-half the nominal height of the fruit F. To decrease the width W, the depth D is increased. Additionally, cell density in a packing tray (i.e., number of cells per unit area) is inversely proportional to the depth of the cells. In other words, a greater number of shallower cells can be formed in a tray of given area than a number of deeper cells, in the same area. It is preferred with the packing trays 10A, 10B that the maximum full diameter T1 of the cells 12 be less than the nominal maximum diameter T2 of the fruit F, thereby providing for relatively shallow cells which can be densely formed. (As used herein the "maximum full diameter" is measured where the cell 12 defines a full enclosed perimeter in a horizontal plane; here, the maximum full diameter coincides with the low point 27. Above the low point 27, the cell 12 does not define a full enclosed perimeter.) Accordingly, the subject invention facilities maximum economy of cell density.

The following ranges of dimensions can be used with the subject invention: the width W having a range of 0.5"–1.0", inclusive; the depth D having a range of 1"–1.625", inclusive; and the maximum full diameter T1 having a range of 2.375"3.25", inclusive. The actual dimensions will be dependent upon the dimensions of the fruit F, including the nominal diameter T2. It is preferred that the depth D be equal to or greater than the width W. It is also preferred that the low points 27 of the cell dividers 22 be located a distance Z from the peripheral edge 20 which is equal to one-half the depth D.

Another benefit of the subject invention lies in the recessing of the cell dividers 22 below the peripheral edge 20. In this manner, the side walls 24 extend beyond at least major portions of the cell dividers 22 and form peripheral buffers about the respective packing trays 10A, 10B. Yet, the cell dividers 22 allow for accommodation of different sized fruit F, due to their limited height, and enable versatility in packing orientation (e.g., fruit can be packed on its side, rather than upright). Furthermore, the constituent foam material of the packing tray 10 imparts the cell dividers 22, the posts 26 and the side walls 24 with forgiveness which allows for limited expansion of the cells 12 in accommodating larger fruit than for which the cells 12 are designed, thereby providing for variations in size in the fruit.

When packed, the cell packs are stacked with the cells 12 being in vertical alignment. As such, the cell centers, such as cell centers 16E of the packing trays 10A, 10B generally lie along a common vertical axis 34 and the peripheral edges 20 are in registration. The cell packs can then be packed in a case, or other transportation/storage container, having an internal area of slightly greater than X•Y to accommodate the packing trays 10A, 10B.

Figure 5:
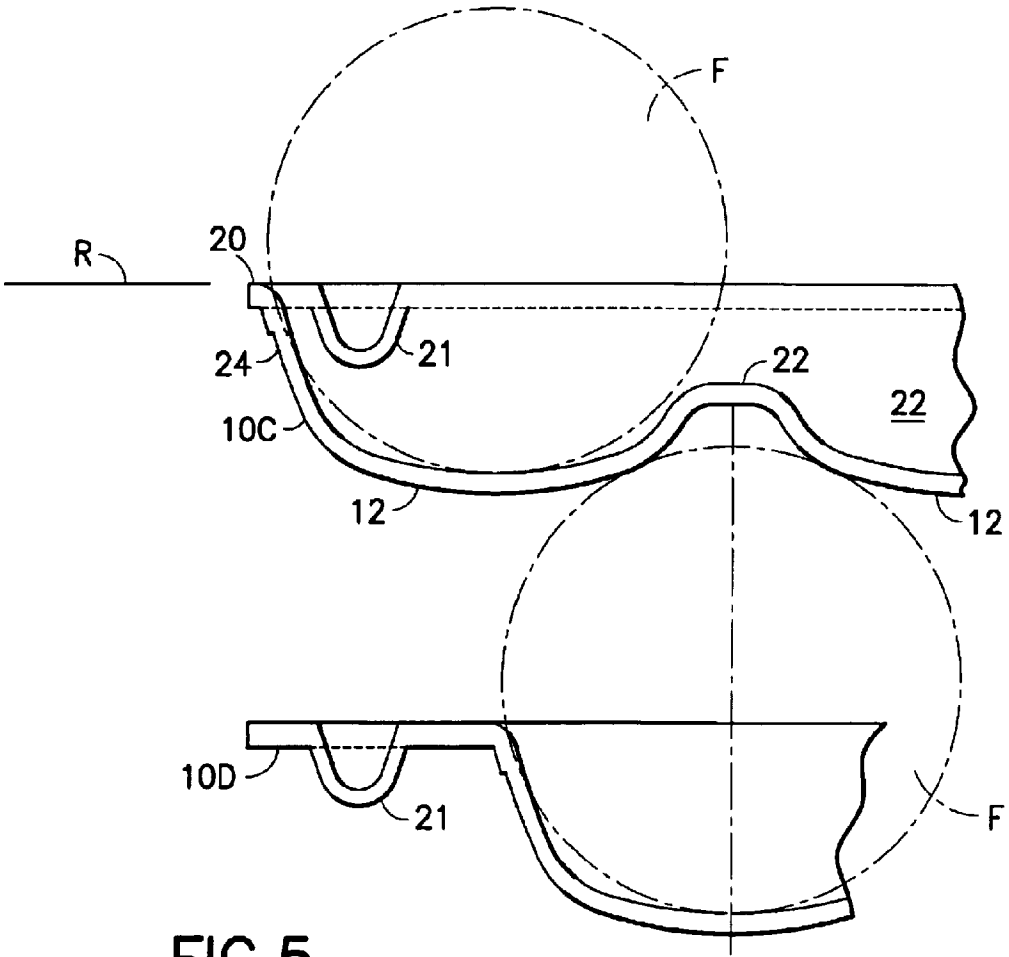
FIG. 5 is a schematic showing the packing tray of the subject invention being used in a tray pack arrangement.

With reference to FIG. 5, the packing tray can be also used in a tray pack arrangement. Here, packing trays 10C, 10D are arranged such that the fruit F of the lower stacked packing tray 10D is nested between, and in abutting contact with, the exterior surfaces of at least two of the cells 12 of the upper stacked packing tray 10C. The bearing engagement of the cells 12 against the fruit F provides a holding force therefor. The cells 12 are preferably formed with smooth outer surfaces to limit damage to the fruit F. Also, the forgiveness of the constituent foam material of the packing trays provides compressibility which deflects under weight of the fruit F and also acts to limit damage to the fruit F.

The configuration of the cells 12 of the packing tray 10 described above allows for the packing trays 10C, 10D to be identically formed. To obtain the stacked relationship shown in FIG. 5, the packing trays 10C, 10D are placed in reversed end-to-end relationship. To illustrate this point, reference is made to FIG. 1 and it is indicated that solid lines depict the lower stacked packing tray 10D, while the cells 12', shown in dashed lines, represent a portion of the upper stacked packing tray 10C in a stacked tray pack arrangement. In this arrangement, the cells 12' are not vertically aligned with the cells 12. This result is achieved by rotating the packing trays so that the cell center 16E of the lower stacked packing tray 10D is directed towards the upper right corner of FIG. 1, and the corresponding cell center 16E' of the upper stacked packing tray 10C is directed towards the lower left corner of FIG. 1.

The same advantages of the low cell dividers 22 described above are equally applicable in this application. Also, the relative dimensioning of the depth D of the cells 12 described above provides the packing tray 10 with deeper cells than a prior art tray pack design, and as such, more protection in packing. In sum, it is preferred that the cells 12 be formed with a depth that is greater than found in prior art tray packs, but less than that found in prior art cell packs.

As is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed.

What is claimed is:

1. A packing tray for packing fragile objects, said packing tray comprising:

a peripheral edge extending about the perimeter of the tray, said peripheral edge having an upper surface with coplanar portions defining a reference plane; and a network of cell dividers arranged to at least partially define a plurality of cup-shaped cells, each of said cells being bounded, at least in part, by a plurality of said cell dividers, each of said cell dividers having two ends and having a major portion between said two ends recessed below said reference plane, said major portion being at least one half of the length of said cell divider, the remaining portions of each of said cell dividers being substantially coplanar with said reference plane, each of said cell dividers joining with a plurality of other said cell dividers at one or both of said two ends to form said network.

2. A packing tray as in claim 1, wherein a post is located at each juncture of multiple cell dividers.

3. A packing tray as in claim 2, wherein one of said posts is located at each juncture of at least three of said cell dividers.

4. A packing tray as in claim 2, wherein each said post defines a top surface that is generally coplanar with said reference plane.

5. A packing tray as in claim 1, wherein said cells are arranged in at least a first row and a second row.

6. A packing tray as in claim 5, wherein said first row includes an even number of said cells.

7. A packing tray as in claim 6, wherein said second row includes an odd number of said cells.

8. A packing tray as in claim 7, wherein said first row includes one more of said cells than said second row.

9. A packing tray as in claim 5, wherein said first row and said second row are generally parallel.

10. A packing tray as in claim 1, wherein the tray comprises polystyrene foam.

11. A packing tray as in claim 10, wherein the tray is unitarily formed.

12. A packing tray as in claim 2, wherein each of said cell dividers is convexly shaped in profile.

13. A packing tray as in claim 12, wherein a first subset of said cell dividers extends between two of said posts, and a second subset of said cell dividers extends between said peripheral edge and one of said posts, wherein each of said cell dividers defines a low point, and wherein each of said first subset cell dividers defines a low point centrally between said associated posts, and each of said second subset cell dividers defines a low point centrally between said peripheral edge and said associated post.

14. A packing tray as in claim 1, wherein each of said cell dividers is saddle shaped.

15. A packing tray as in claim 1, wherein the maximum full diameter defined by each of said cells is less than the nominal maximum diameter of the object to be packed.

* * * * *